US006264437B1

(12) United States Patent
Porel

(10) Patent No.: US 6,264,437 B1
(45) Date of Patent: Jul. 24, 2001

(54) HIGH PRESSURE PUMP FOR ALL LIQUIDS

(75) Inventor: Louis-Claude Porel, Jeanmenil (FR)

(73) Assignee: Hydro Rene Leduc, Azerailles (FR)

( * ) Notice: Subject to any disclaimer, the term of this patent is extended or adjusted under 35 U.S.C. 154(b) by 0 days.

(21) Appl. No.: 09/194,437

(22) PCT Filed: May 30, 1997

(86) PCT No.: PCT/FR97/00943

§ 371 Date: May 10, 1999

§ 102(e) Date: May 10, 1999

(87) PCT Pub. No.: WO97/47883

PCT Pub. Date: Dec. 18, 1997

(30) Foreign Application Priority Data

Jun. 7, 1996 (FR) ..... 96 07043
Nov. 6, 1996 (FR) ..... 96 13502

(51) Int. Cl.[7] ..... F04B 9/08

(52) U.S. Cl. ..... 417/390; 417/386; 417/269; 417/388; 417/222; 417/413; 417/387; 417/383; 123/446; 105/96.1

(58) Field of Search ..... 417/386, 269, 417/388, 222, 413, 387, 383, 390; 123/446; 105/96.1

(56) References Cited

U.S. PATENT DOCUMENTS

| | | | | |
|---|---|---|---|---|
| 2,301,407 | | 11/1942 | Houser et al. . | |
| 2,433,222 | | 12/1947 | Huber . | |
| 2,960,936 | | 11/1960 | Dean . | |
| 3,873,240 | * | 3/1975 | Leduc et al. | 417/222 |
| 3,884,598 | * | 5/1975 | Wanner | 417/386 |
| 3,981,630 | * | 9/1976 | Leduc et al. | 417/269 |
| 4,392,787 | | 7/1983 | Notta . | |
| 4,443,160 | | 4/1984 | Berthold . | |
| 4,465,438 | * | 8/1984 | Brauer et al. | 417/386 |
| 4,573,885 | * | 3/1986 | Petersen | 417/383 |
| 4,594,058 | * | 6/1986 | Fischell | 417/413 |
| 4,667,638 | * | 5/1987 | Igashira et al. | 123/446 |
| 4,749,342 | * | 6/1988 | Fritsch | 417/388 |
| 4,773,831 | * | 9/1988 | Brauer et al. | 417/387 |
| 4,880,360 | * | 11/1989 | Terauchi et al. | 417/222 |
| 4,964,345 | * | 10/1990 | Porel | 105/96.1 |
| 4,993,925 | * | 2/1991 | Becker et al. | 417/413 |
| 5,246,351 | * | 9/1993 | Horn et al. | 417/387 |
| 5,554,008 | * | 9/1996 | Porel | 417/269 |
| 5,707,219 | * | 1/1998 | Powers | 417/386 |
| 5,899,671 | * | 5/1999 | Horn | 417/387 |

FOREIGN PATENT DOCUMENTS

| | | |
|---|---|---|
| 24 47 741 | 4/1975 | (DE) . |
| 29 46 529 | 5/1981 | (DE) . |
| 1 122 769 | 9/1956 | (FR) . |
| 1 211 846 | 3/1960 | (FR) . |
| 2 119 364 | 8/1972 | (FR) . |
| 2 162 332 | 7/1973 | (FR) . |

* cited by examiner

*Primary Examiner*—Timothy S. Thorpe
*Assistant Examiner*—Steven Brown
(74) *Attorney, Agent, or Firm*—Nixon & Vanderhye P.C.

(57) ABSTRACT

A device enables the pumping of any kind of liquid while giving the liquid very high delivery pressure. The units that cause pumped liquid suction and then its delivery are driven exclusively by hydraulic means excluding mechanical means. So that there is no material contact between the driving units and the pumped product and that the product cannot damage the mechanical driving units, the chamber receiving the hydraulic fluid is, at the end of each compression cycle, placed again in direct communication with the hydraulic fluid reservoir.

25 Claims, 6 Drawing Sheets

HIGH PRESSURE PUMP FOR ALL LIQUIDS

BACKGROUND

This invention relates to a pump intended for high pressure pumping and delivery of almost any liquid such as water, petrol, gas oil, oils, corrosive chemical liquids and sludge, but more particularly for the high pressure supply of fuel injectors for internal combustion engines.

Low pressure pumps are known for liquids of this type, and are generally centrifugal pumps, gear pumps, sometimes piston pumps or other types of pumps. With these known pumps, a high delivery pressure (in excess of 50 bars) either cannot be obtained or only with great difficulty and at great expense due to the fact that, once one starts using high pressures, the moving parts begin to seize and substantial leaking occurs due to the often very low viscosity of the liquids pumped.

To avoid such seizure or leakage, diaphragm pumps have been known to be used, in which case it becomes impossible to achieve high delivery pressure. In fact, the diaphragm is driven by a mechanical means (cam, lever or the like) on one side, and is subjected on the other side to the delivery pressure: it ensures that, once the pressure becomes high, the diaphragm deteriorates at the points where mechanical stress is applied.

Also known, to pump special liquids such as corrosive liquids, is the association of two pumps: a first pump which is a hydraulic pump that delivers and draws back a hydraulic liquid which, by way of reciprocating motion, drives the mobile elements of a second pump which draws in and pressurizes the liquid to be pumped. These mobile elements which ensure physical separation of the hydraulic liquid and the liquid to be pumped, though driven in reciprocating motion by the hydraulic liquid, are either deformable diaphragms or free-floating pistons.

The free-floating pistons are defective from the point of view of tightness, and this defect cannot be overcome when absolute tightness is required. If a seal is fitted between the free-floating piston and the cylinder in which it moves, perfect tightness cannot be obtained. If the seal is eliminated, either there will be a very thin film of oil between the friction surfaces and therefore micro-leakage, or the rubbing surfaces will heat up if there is no film of oil. In the particular case of high pressure fuel injection, no leakage, no matter how small, can be tolerated and, of course, heating is liable to cause an explosion.

The known free-floating piston-type devices, such as e.g., U.S. Pat. No. 4,443,160, must therefore be ruled out.

The invention thus relates to a pumping device in which the mobile elements—to which a reciprocating pumping motion is imparted by the hydraulic pump and which ensure a perfectly tight separation between the hydraulic "driving" liquid and the liquid to be pumped—are deformable diaphragms.

Generally, this type of deformable diaphragm pump has at least one of the following drawbacks and sometimes several simultaneously:

a—if the separating and pumping diaphragm is mechanically linked to the piston of the hydraulic pump, there is not equal pressure on both sides of the flexible diaphragm as a result of which the latter will not last over time, it will deteriorate;

b—if the diaphragm is completely free, i.e., unattached to any drive mechanism and driven solely by the hydraulic liquid delivered by the pump, there will be equality of pressure on the two sides of the diaphragm. However, due to inevitable leaks, even very minute ones, the volume of hydraulic liquid delivered increases with each cycle and ultimately exceeds the volume the diaphragm can deliver; this causes a hydraulic blocking which creates so much excess pressure that one or other of the pumps breaks. In the particular case of high pressure fuel injection, if the element that breaks is the element delivering the fuel, fire will inevitably break out, c—in both eases, i.e., whether the diaphragm is attached to the piston or unattached, if the volume of hydraulic liquid continually being drawn in and delivered is constantly the same, the diaphragm will heat up as a result of the indefinitely repeated compression cycles, until it reaches a temperature such that the diaphragm (s) break.

U.S. Pat. No. 4,392,787 granted to Notta discloses a unit including a hydraulic slanted plant pump, each piston of the pump being associated at its end with a flexible diaphragm which is connected to a rod that slides inside the piston. This device has the drawbacks described above in "a" and "c". The volume of liquid continually pressurized is always the same and will therefore heat up. Moreover, the inevitable little leaks are offset by the intake of additional oil via a non-return valve, but should a substantial leak accidentally occur, the piston will come into mechanical contact with the diaphragm thus destroying the latter.

U.S. Pat. No. 2,960,936 granted to Dean describes a pump in which a completely unattached diaphragm is cyclically pressed and released by a hydraulic volume displaced by a cam-driven piston. This device has drawbacks "b" and "c". If, for any reason, the supply were to be stopped or slowed down, the diaphragm would not completely redeploy itself and a corresponding quantity of hydraulic liquid would be introduced at each cycle until the occurrence of breakage (drawback "b"). Furthermore, as the volume of hydraulic liquid compressed is always the same, heating will inevitably take place (drawback "c").

German Patent No. 2,447,741 granted to Wanner discloses a diaphragm pump mechanically linked to a piston which slides inside a hydraulic pump piston. The drawbacks are the same as for above-mentioned U.S. Pat. No. 4,392,787.

SUMMARY OF THE INVENTION

To remedy these drawbacks, the invention provides a device in which each diaphragm is unattached and in which, at the end of each piston cycle, the "dead" chamber situated downstream of the top dead center of this piston (position of maximum compression), in which the liquid is in contact with the diaphragm, is made to communicate with the reserve of hydraulic liquid; as a result, the liquid situated in the chamber is forced back towards this reserve firstly by the expansion of the liquid and then by the forcing effect of the diaphragm which is held in countercheck by a spring.

We thus obtain, on the one hand, a continuously repeated heat exchange between the compressed liquid and the liquid that is not compressed, and, on the other hand, a return of the diaphragm to its initial position at each cycle or, in other words, a suppression of any increase in volume of the hydraulic liquid acting on the diaphragm, increase that is inevitably caused on an on-point basis by leaks; this is because it is not possible to manufacture a high pressure hydraulic pump with pistons, which does not heat up and which has a satisfactory, leak-free output.

According to a first object, the invention relates to a pump enabling any type of liquid to be pumped while imparting a very high delivery pressure thereto, of the type comprised by the association of two pumps: on the one hand, a hydraulic pump, and, on the other hand, a second pump in which the mobile means performing the suction and delivery of the liquid to be pumped, are flexible diaphragms to which reciprocating motion is imparted, first in one direction and then in the other, by the displacement of the hydraulic liquid pumped then drawn back by the first pump. The pistons of the first pump are tubular and passed through by the hydraulic liquid which, during the suction phase, passes through a crescent or groove hollowed out in the surface of the slanted plate or cam. The deformable diaphragms each are held in countercheck by a spring in such a way that, at the end of the compression stroke of each piston, communication is established between the chamber in which the hydraulic liquid finds itself forced against the diaphragm, and the suction chamber, this liquid being, on the one hand, sucked up by the motion of the piston and forced back by the diaphragm under the effect of its spring action, thus ensuring, on the one hand, an exchange between the hydraulic liquid heated by compression and the unheated liquid, and, on the other hand, the return of the diaphragm to its initial position.

The pump embodying the invention can also include one or other of the following arrangements:

a—the second pump comprises as many volumes or bores as the first pump has bores, each bore of the second pump communicating directly with the corresponding bore of the first pump so that each piston of the first pump cyclically delivers and draws the hydraulic liquid into the corresponding bore of the second pump;

b—each bore of the second pump is divided into two parts by a deformable diaphragm held in countercheck by a spring, the part communicating with the corresponding bore of the first pump receiving the hydraulic liquid delivered and drawn back by the first pump, and the other part, which is fitted with suction and delivery valves, performing suction and delivery of the product to be pumped;

c—the chamber in which the piston heads move back and forth is connected to a reservoir of hydraulic liquid;

d—the reservoir of hydraulic liquid is on the exterior of the first pump and communicates with the latter by means of a pipe leading into the chamber;

e—the pump embodying the invention is destined for the high pressure supply of fuel injectors for internal combustion engines, and the hydraulic liquid of the first pump (I) can be the oil of the engine.

According to a second object, the invention relates to a means enabling variation of the cubic capacity of the first pump and therefore of the flow rate of fuel towards the injection devices.

This means is either the arrangement of a slated plate of variable inclination or the arrangement of a means, in the pistons of the hydraulic pump, having as function to short-circuit all or part of the volume of hydraulic liquid introduced into the bore during the suction phase.

According to the invention, each tubular piston of the hydraulic pump is fitted with holes that can be totally or partly obstructed by a mobile liner, all the mobile lines being moved together by a control unit driven by the operating conditions of the engine.

This device can furthermore comprise one or other of the following arrangements:

a—the pistons slide in two support members drilled with orifices, the two support members being separated from one another by an annular space, constituting a chamber, in which the liners moved between two extreme positions: in one of these positions, as the orifices are not obstructed by the liner, all the liquid delivered by each piston flows back into the annular chamber via the orifices of the piston as the pump (I) rate is zero; in the other of these positions, as all the orifices are covered by the liners, each piston forces back all the hydraulic liquid drawn in, the flow rate of the pump then being at maximum.

b—the liners can be in all intermediate positions included between the two extreme positions, as a result of which the flow rate of the pump (I) can be set at all values included between zero and the maximum rate.

c—the liners are coupled to a common control unit which is driven by any control device appropriate for the regulation of the high pressure flow of fuel as a function of the engine supply requirements without any reflux of high pressure fuel to the reservoir.

d—a damping device can be located downstream of the outlet of the second pump (II) and upstream of the injectors to cancel the pulsation effect brought about by the first pump (I).

e—the damping device can be a capacity of sizable volume in relation to the fuel rate, maintained at the injection pressure by any appropriate means and can behave substantially in the manner of a hydromechanical accumulator.

BRIEF DESCRIPTION OF THE DRAWINGS

Further features and advantages of the invention will be apparent from embodiments of the invention described, by way of non-limiting examples, in reference to the corresponding accompanying drawings in which.

DETAILED DESCRIPTION OF PREFERRED EMBODIMENTS

Figure 1:
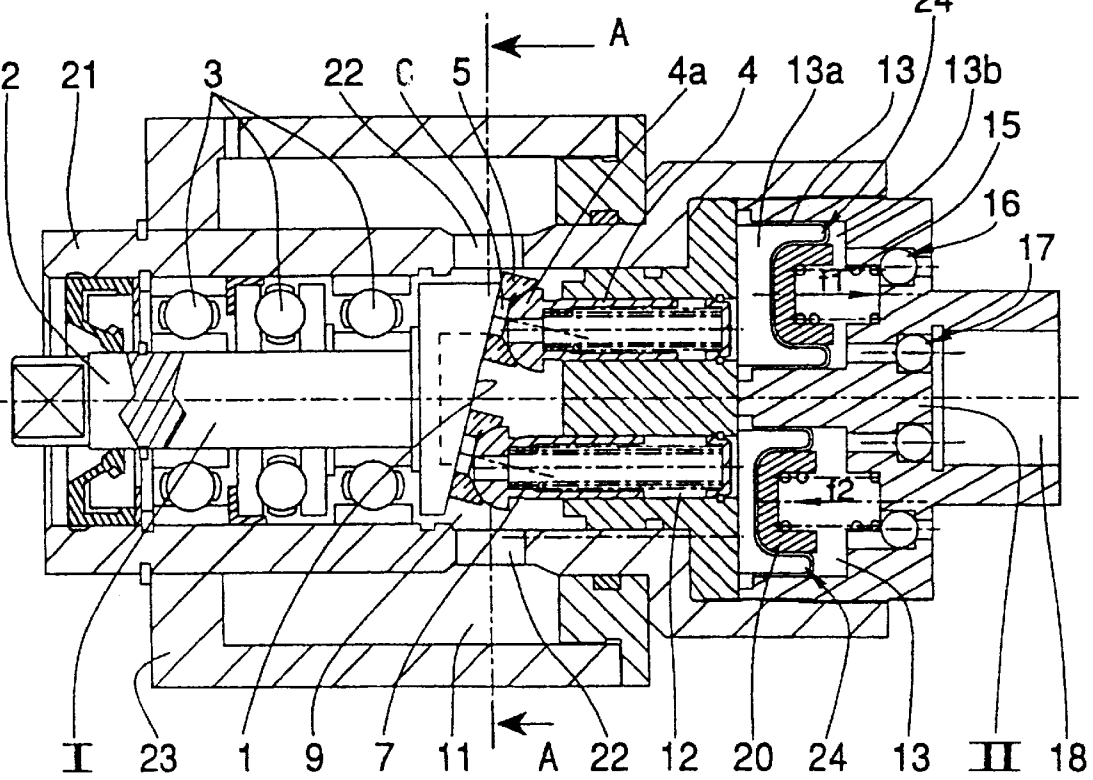
FIG. 1 is a longitudinal cross-section of a first embodiment of the invention.
Figure 2:
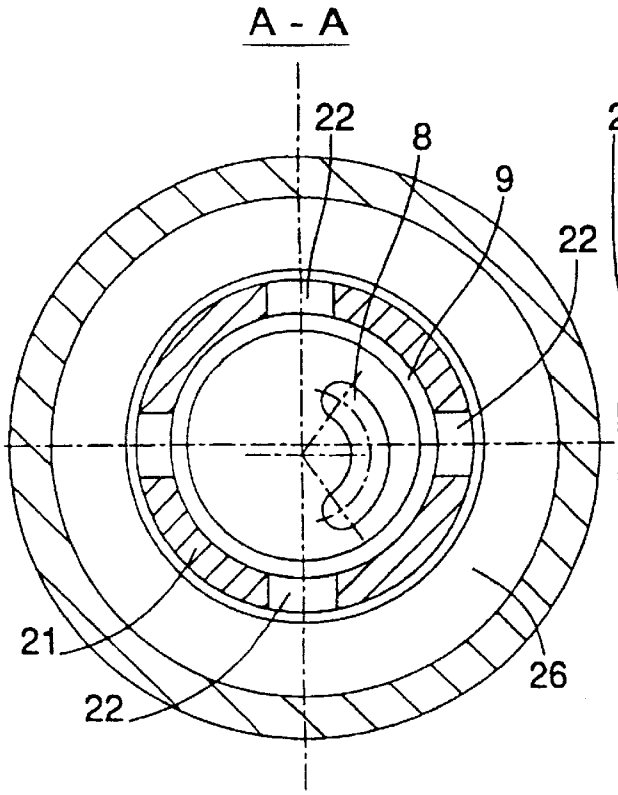
FIG. 2 is a transversal cross-section according to A—A in FIG. 1.

In reference to FIGS. 1 and 2, the device embodying the invention can be seen to comprise a first pump, designated by the general reference "I", and a second pump designated by the general reference "II".

The first pump I is a pump with axial pistons driven in reciprocating to-and-fro motion by a slanted plate 1.

The slanted plate 1 is integral with a primary shaft 2 (driven by any means not represented) borne by bearings 3. A plurality of tubular pistons bear against the slated face of the plate 1, each by means of a sliding contact piece 5 drilled through at its center by a bore 6. Each piston 4 is held against its contact piece by a spring 7. A crescent 8 is engraved on the front side 1. When the shaft 2 is driven in rotation, the slated plate 1, the contact pieces 5 and the spherical heads 4*a* of the pistons 4 move back and forth in the chamber 9. The chamber 9 opens out, via a plurality of bores 22 passing through the case 21 of the pump I, into a reservoir 11. This reservoir 11 is constituted by a cylindrical envelope 23 surrounding the case 21.

When the primary shaft 2 rotates, the face of the slanted plate 1 oscillates in the chamber 9 in such a way that the pistons 4 are driven in reciprocating to-and-fro motion: in the direction corresponding to suction, the pistons 4 are driven by their spring 7, and in the other direction, corresponding to pressurized delivery, they are thrust back against the spring 7 by the slanted plate 1. During the suction phase, the hydraulic liquid in the chamber 9 passes into the pistons 4 via the crescent 8 and the bore 6 in each contacting piece 5.

This type of pump is known and described in numerous prior patents granted to the Applicant hereof.

When the hydraulic pump I is used in a known manner, each bore 12, within which slides a tubular piston 4, comprises a non-return valve at its end so that the pistons 4 together cause a pressurized flow (even a high pressure flow since 1000 bars can be exceeded with this type of pump).

However, within the framework of the invention, none of the bores 12, in which the pistons 4 slide, comprises a non-return valve.

A pump II is associated with the pump I, immediately downstream of the latter.

To each bore 12 of the pump I, in which a piston 4 slides, corresponds, in pump II, a chamber or bore 13 divided into two parts 13*a* and 13*b* by a flexible diaphragm 24 held in countercheck by a spring 15. Part 13*a* communicates directly with the end of the bore 12, whereas part 13*b*is fitted, at its end opposite the diaphragm 24, with a suction valve 16 and a delivery valve 17. All the valves 17 flow into a common pipe 18.

Preferably, as represented, each spring 15 bears against the rear side of the diaphragm 24 via a collar 20. The shape of the collar 20 is determined in such a way that the bearing of the collar 20 against the rear side of the diaphragm 24 does not deteriorate the latter in any way.

The working thereof will be described hereunder:

When the primary shaft 2 is driven, the pistons 4 force the hydraulic liquid back into the chambers 13. The hydraulic liquid forced back into part 13*a* of the chamber 13 bears against the front side of the diaphragm 24, causing the latter to be displaced in the direction of the arrow f1 (FIG. 1). In moving, this diaphragm 24 forces back the liquid contained in part 13*b* of the chamber 13. This delivery is carried out via the non-return valve 17.

Then, when the slated plate 1 continues to turn, the contact piece 5 of each piston 4 passes over the crescent 8, and this makes the chamber 13*a*, the inside of the tubular piston 4 and the suction chamber 9 communicate with one another. At the very start of the stroke of the contact piece 5 on the crescent 8, the pressurized liquid situated in the chamber 13*a* expands in the direction of the chamber 9; then, under the effect of the spring 7 of the piston 4 and of the spring 15 of the diaphragm 24, the liquid situated in the chamber 13*a* is forced back into the bore 12 and from there onwards towards the chamber 9.

Thus, the hydraulic liquid, situated in the "dead" chamber at the end of each bore 12 when the piston 4 is at the end of its compression stroke and in the chamber 13*a*, is renewed at the end of each compression cycle, thus avoiding any heating of the liquid which would otherwise be inevitable. Moreover, this putting of the chamber 13*a* and the chamber 9 into communication with one another, at each cycle, materializes a resetting of the mobile elements to their initial position so that the volume of hydraulic liquid forced back into the chamber 13*a* remains rigorously unchanged, with the inevitable leaks of the hydraulic pump being returned into the chamber 9. By establishing communication between the chambers 9 and 13*a*, the drawbacks described above in "b" and "c" are remedied.

Displacement of the diaphragm 24 in the direction of the arrow f2 has the effect of drawing the product to be pumped into the part 13*b* of the bore 13, via the non-return intake valve 16 (e.g., via inlet at 28, 28*a* in FIG. 3), and of forcing back the hydraulic liquid situated in part 13*a*.

Thus, the product to be pumped is alternately subjected to suction then delivery by the reciprocating motion of the diaphragms 24, this motion being caused by the variations in the volume occupied by the hydraulic liquid in the parts 13*a* of the bores 13, these variations in volume being brought about by the alternated suction and delivery of the hydraulic liquid by the pistons 4 of the first pump I.

Each diaphragm 24 is subjected to the same pressure, on both its front and rear side and evenly over the entire area of the diaphragm: on one side, the pressure of the hydraulic "driving" liquid and on the other side the pressure of the liquid forced back. The diaphragm is not therefore subjected to any mechanical stress and cannot therefore be torn.

The pump embodying the invention is therefore a diaphragm pump in which each diaphragm is, during the delivery phase, subjected to the same pressure on each of its sides, which makes it possible to have a delivery pressure equal to the hydraulic pressure the first pump I is capable of producing.

The pump embodying the invention can be used, among other things, to pressurize liquids devoid of any lubricating power. In particular, it can be used to supply injectors for an internal combustion engine (automobile engines) powered by premium fuel and/or liquefied petroleum gas (LPG), e.g., as a replacement fuel. The premium fuel is drawn in by the valves 16, and delivered under pressure (over 50 bars) by the valve 17 without the fuel ever being brought into contact with the metal parts sliding against one another.

It should be noted that, at high pressures, liquids can no longer be deemed incompressible. When a piston 4 reaches the end of its delivery stroke, the pressure of the hydraulic liquid is at its maximum. As stated above, when the contact piece 5 is positioned at the start of the crescent 8, the liquid, when it expands, will be delivered via the piston 4, the passage 6 of the contact piece 5 and the crescent 8 into the chamber 9; it will then be delivered by way of the effect of the spring 15. Though the compressed liquid is hot, the liquid in the chamber 9 and in the reservoir is not: thus, at each cycle, there will therefore be a small exchange of liquid heated by compression and unheated liquid, thus ensuring the thermal balance of the first pump I. Preferably, though it is not represented, the cylindrical envelope 23 of the reservoir will be fitted with cooling fins.

In the case of the double pump embodying the invention being used, as stated above, to provide a high pressure supply to fuel injectors for engines, the engine oil itself can be advantageously used as hydraulic liquid by having the chamber 9 communicate directly with the engine oil distribution circuit, the temperature of this oil being regulated by the appropriate engine devices.

The pump embodying the invention can also be used for the pressurized circulation of drilling mud.

In fact, it can be used to pressurize any liquid whatsoever, including corrosive and aggressive liquids.

In the event of the hydraulic stage, pump I, being confronted with a high viscosity liquid, as is the case e.g., when used cold, it is preferable, as is known, to have a mechanical means maintaining the heads 4*a*of the pistons 4 on their contact pieces 5 during the suction phase.

As explained above, the suction stress of the second pump II, which is linked to the power of the springs 15, enables the diaphragms 24 to be returned to their initial position, due to the communication established with the chamber 9.

Were it not for this return to the initial position, made possible for this communication with the reserve of hydraulic liquid, there would be a risk of a slight drift occurring with each cycle of the pump.

This drift would rapidly generate a difference in volumes between the bore 12 and the part 13*a*of the corresponding bore 13 which, in turn, would cause the diaphragms 24 to abut, and the pump to break immediately (either at the level of the first pump I or at the level of the second pump II).

Thus, it would appear that this zeroizing, or resetting to their initial position of the mobile elements 24 of the second pump II, via the crescent 8, is indeed crucial.

Figure 3:
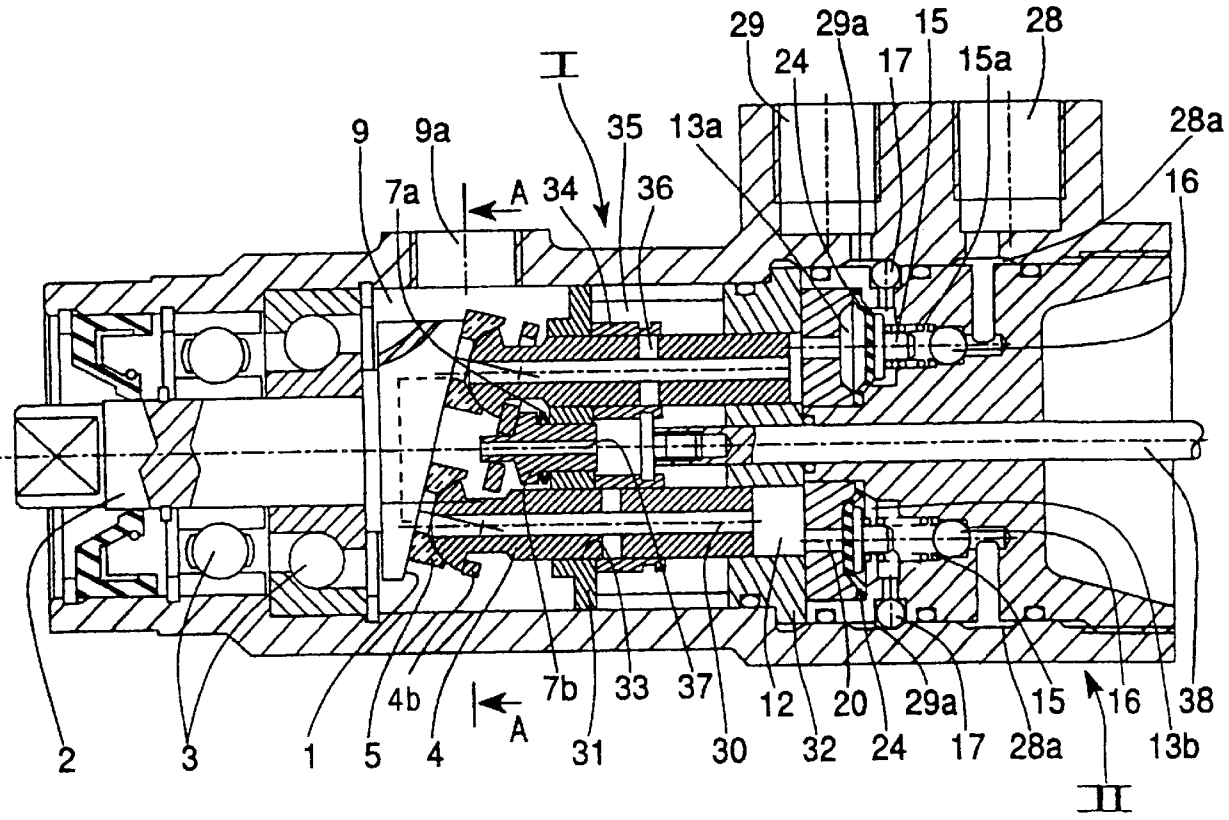
FIG. 3 is a longitudinal cross-section of the variable-rate double pump, the parts being in the position corresponding to the maximum flow rate.
Figure 5:
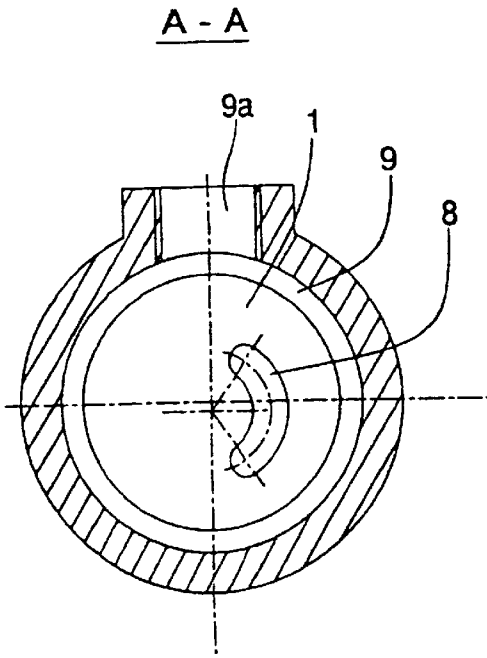
FIG. 5 is a view along A—A of the face of the slanted plate in FIGS. 3 and 4.
Figure 4:
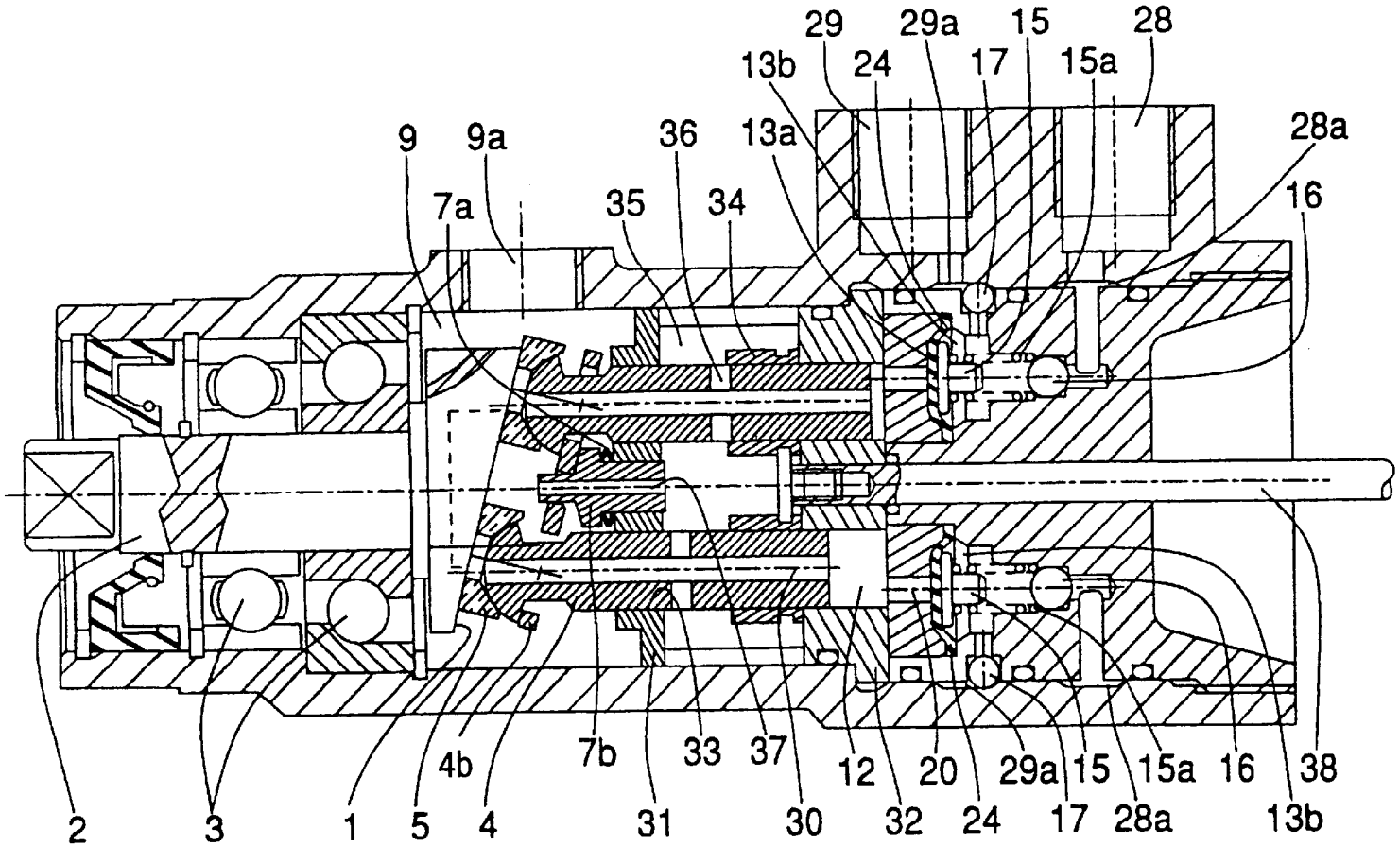
FIG. 4 is a view of the double pump in FIG. 3, the parts being in the position corresponding to the zero flow rate.

FIGS. 3 to 5 relate to an enhancement of the device in FIGS. 1 and 2 by means of which it will be possible to vary at will the flow rate of the liquid to be pumped.

When this liquid is fuel intended to power an engine, it can be of interest to vary the volume of fuel pumped by the pump II in order to adapt it to the running conditions of the engine.

For an engine to operate at full speed, the cubic capacity of the pump must be determined as a function of the extreme conditions of use of the engine, i.e., running at full speed and with a full load. This thus defines the maximum pumping rate available at all times, so that, over and beyond these extreme conditions of use, the pump supplies a surplus rate which is returned to the reservoir.

However, fuel that is thus returned to the reservoir has been heated by compression, as a result of which hot fuel is constantly being returned to the reservoir. As the reservoir gradually empties, the fuel becomes increasingly hot whence a risk of having unwanted fuel vapors appear in the reservoir, and these have become difficult to treat due to increasingly strict standards especially as regards direct fuel injection engines.

It has therefore proved necessary to modulate the pumping rate according to engine requirements.

The first solution consists in manufacturing the first pump I, in the form of a variable rate pump, by using a slanted plate of variable slant as is the case in certain pumps manufactured by the Applicant hereof.

However, such a pump risks being too costly for large scale series production of automobiles, as a result of which a second solution is described below.

The device according to this second solution comprises a double pump such as the one disclosed in patent application No. 96.07043, but in which each piston of the hydraulic pump is lifted with a means enabling cancellation of all or part of the flow rate pumped by the pump.

FIGS. 3 and 4 illustrate a double pump similar to those in FIGS. 1 and 2 in which the same elements bear the same references.

In reference to these figures, each tubular piston 4 can be seen to be completely passed through by a pipe 30.

Furthermore, the pistons 4 are borne by two support members 31 and 32 drilled with orifices in which the pistons slide. The orifices drilled in the support member 31 are designated by the reference 33, whereas the orifices drilled in the support member 32 constitute the above-mentioned cylinders. To this end, the thickness of the support member 32 is greater than the maximum stroke of the pistons 4.

The space included between the support members 31 and 32 constitutes an annular chamber 35.

In this space 35, each piston 4 is partially covered by a sliding liner 34. These sliding liners are all connected to a control rod 38 in order to be capable of all sliding together between two extreme positions, the first of which is illustrated in FIG. 3 and the second of which is illustrated in FIG. 4.

In the position represented in FIG. 3, the liners 34 obstruct the drilled holes 36 which establish communication between the internal pipe 30 of each piston 4 and the annular chamber 35. In the position represented in FIG. 4, the liners 34 reveal the drilled holes 36.

The springs 7 of FIGS. 1 and 2, whose function is to maintain the piston heads held against their sliding contact pieces 5, are replaced by a tappet 7*b* which acts on a flange 4*b* bearing against the rear side of each piston head 4. The tappet 7*b* is held in countercheck by a spring 7*a*.

The tappet 7*b*, holding the flange 4*b* of each piston head in countercheck, is passed through by a pipe 37 establishing communication between the two chambers 9 and 35.

Thus, when, under the effect of the control rod 38, the liners 34 are in the position represented in FIG. 4, the hydraulic liquid forced back by each piston 4 flows back, via the pipes 30 and 36, to the annular chamber 35 and from there, via the bore 37, into the chamber 9 and inlet/outlet 9*a*. It ensures that the flow rate of the hydraulic pump I is zero, and therefore that the diaphragms are motionless and do not have any pressurized suction or delivery effect on fuel to the injectors; the fuel flow rate towards the injectors is therefore also zero.

When, under the effect of the control rod 38, the liners 34 are in the position represented in FIG. 3, the bores 36 are obstructed by the liners and the flow rate of the hydraulic pump I is at its maximum. It ensures that the fuel flow rate to the injectors is also at maximum.

Between these two extreme positions all the intermediate flow rates can be obtained as a function of the position of the liners 34, the position being determined by the position of the rod 38 which is controlled by the running of the engine by any appropriate monitoring means.

It ensures that the output rate of the pump I is regulated as a function of the fuel flow rate required for the injection and that surplus fuel reflux to the reservoir is kept as low as possible.

It should be noted, however, that the fuel flow rate thus obtained is a pulsated rate. In fact, if, for instance, the liners 34 are in a position such that only 10% of the maximum rate of the pump I is being supplied into the part 13*a* of the volume 13, this means that the pump I does not have any output during 90% of the stroke of each piston, or that there is only an output during 10% of the stroke of each piston. The flow rate is thus effectively a pulsated flow rate.

This causes a drawback that must be remedied.

To this end, a device is placed, downstream of the outlet 29 and upstream of the injectors, to eliminate these pulsations. This device can advantageously be constituted in a manner similar to a hydraulic accumulator, i.e., constituted by a capacity having a volume that is high in relation to the flow rate supplied to the injectors and maintained at a constant pressure.

The injection rate thus obtained corresponds exactly to the fuel requirements of the engine, without any reflux to the reservoir as this rate is regular, i.e., devoid of pulsations.

Figures 6, 7, 8:
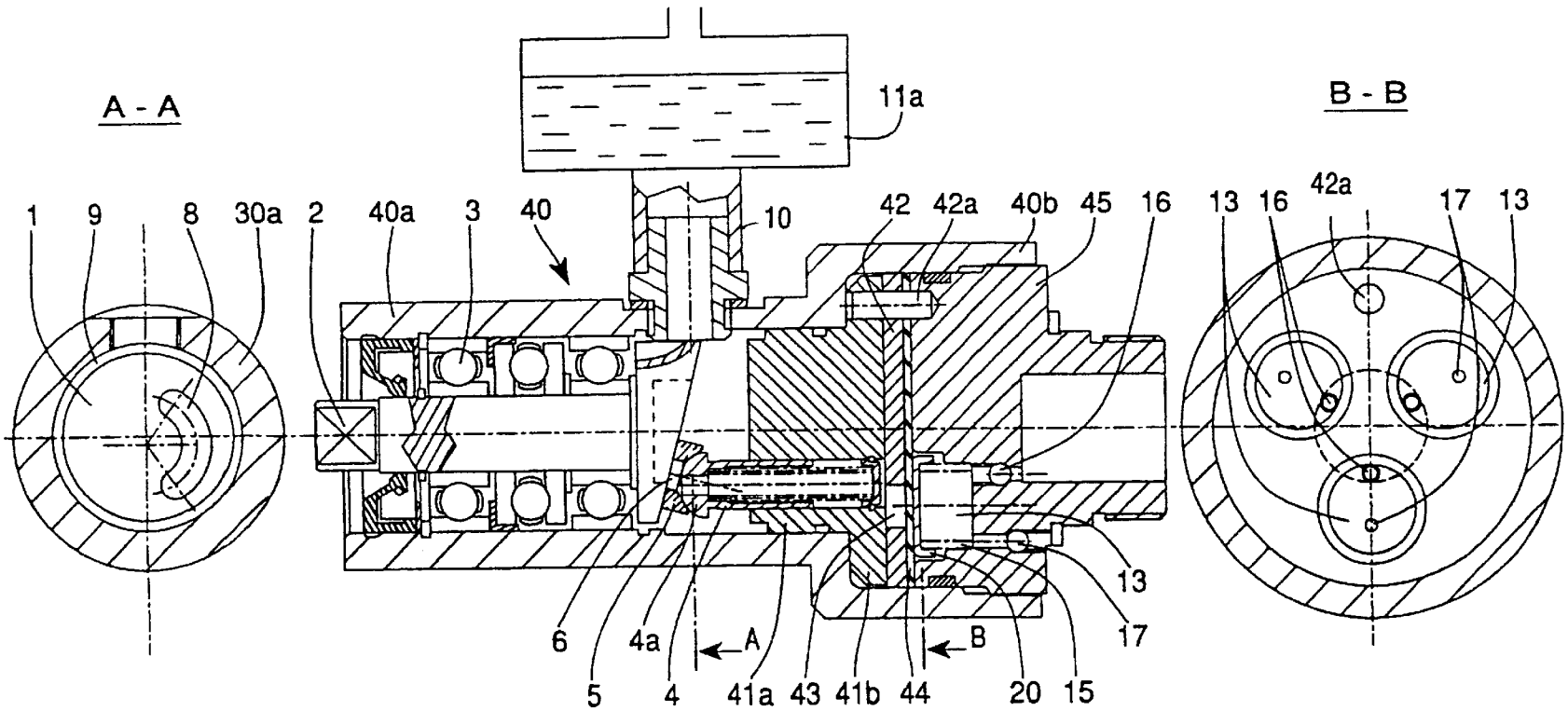
FIG. 6 is a longitudinal cross-section of the pump in FIG. 1 in which the individual diaphragms have been replaced by a single diaphragm.
FIG. 7 is a cross-sectional view along A—A of FIG. 6.
FIG. 8 is a cross-sectional view along B—B of FIG. 6.

FIG. 6 represents a pump similar to the pump in FIG. 1, in which the same elements bear the same references.

The reservoir 11 of FIG. 1, which surrounds the hydraulic pump, is replaced by an exterior reservoir 11*a* that communicates with the chamber 9 via a pipe 10; otherwise all the other components are identical, with the exception of the diaphragm of the pump II in FIG. 1.

In the pump in FIG. 1, each volume 13 is divided into two parts 13*a*, 13*b* by a diaphragm 24 thrust back by a spring 15 resting against the diaphragm 24 by means of a collar 20.

In the pump in FIG. 6, the individual diaphragms 24 are replaced by a single diaphragm 44 which, at the level of the chambers 13, will become deformed so as to partially penetrate the volume 13 against the corresponding spring 15.

More precisely, the pump of FIG. 1, as that of FIG. 6, comprises a monobloc pump housing 40, in two cylindrical portions 40*a* and 40*b*, portion 40*b* having an inside diameter greater than that of portion 40*a*. In the portion 40*a* are arranged the bearings 3, the primary shaft 2, the slanted plate 1, the supply chamber 9 and the rear portion 41*a* of a part 41 in which the bores 12 are drilled. The front portion 41*b* of this part is located in the portion 40*b* of greater diameter of the housing 40 so that this front part 41*b* rests on the shoulder separating the two portions 40*a* and 40*b* of the housing 40. The bores 12 of the pistons 4 open out on the front side of this portion 41*b*. A circular plate 42 is arranged against the portion 41*a* and is locked into position in relation thereto by means of a pin 42*a*. This plate 42 comprises as many drilled holes 43 as there are bores 12 and chambers 13. The chambers 13 are made in a part 45 which is screwed to the open end of the portion 40*b* of the housing 40. Between the part 45 and the plate 42 is located a diaphragm 44 which is in the shape of a disk of the same diameter as the plate 42. The diaphragm 44 is cramped between the plate 42 and the end of the part 45. Each drilled hole 43 communicates with a bore 12 of the pump I and is situated opposite a volume 13.

When a piston 4 forces back hydraulic liquid under high pressure, this liquid will be forced out of the bore 12, into the drilled hole 43 and will deform the portion of the diaphragm 44 located opposite the corresponding chamber 13, this deformation acting against the spring 15 bearing against the other side of the diaphragm by means of the collar 20. The liquid to be pumped and which is situated in the chamber 13 (behind the collar 20) is forced back via the non-return valve 17. When the piston 4 retreats in its bore 12, the portion of the diaphragm 44 which had become deformed and partially penetrated the volume 13, is pushed back by the spring 15 and returns to its initial shape while exerting suction on the liquid to be pumped via the non-return valve 16.

As in the previous cases, there is direct communication between the drilled hole 43 and the chamber 9 via the crescent 8.

Figure 9A:
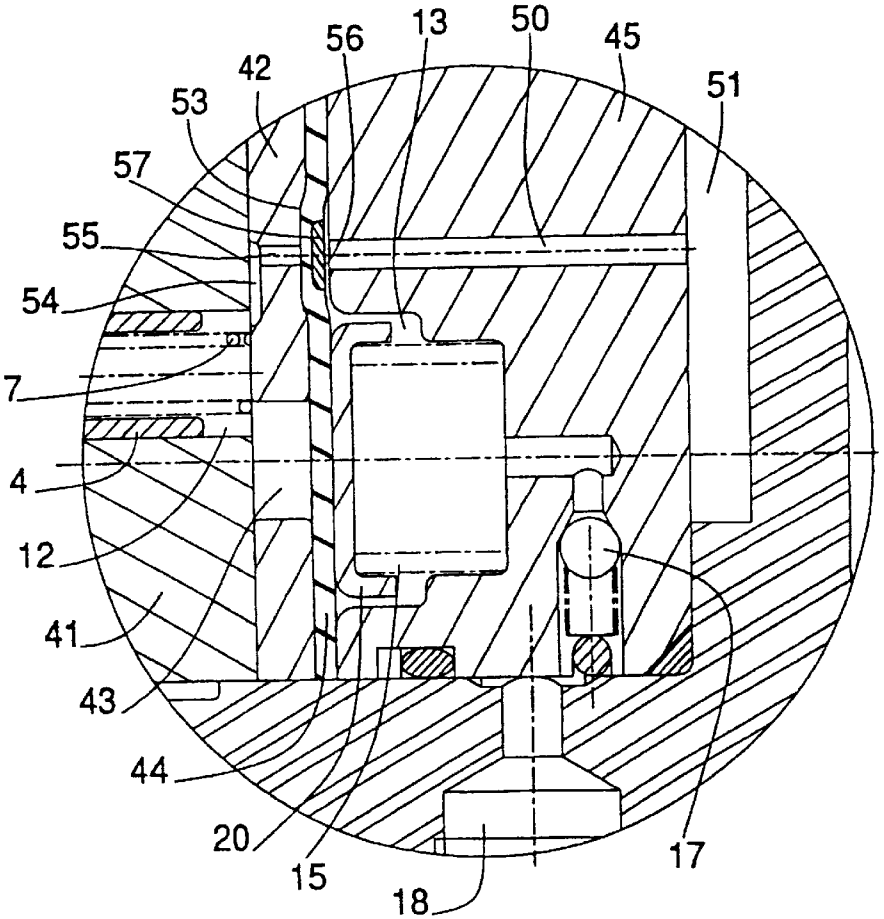
FIG. 9*a* is a detailed view of part of FIG. 9, on a larger scale.
Figure 9:
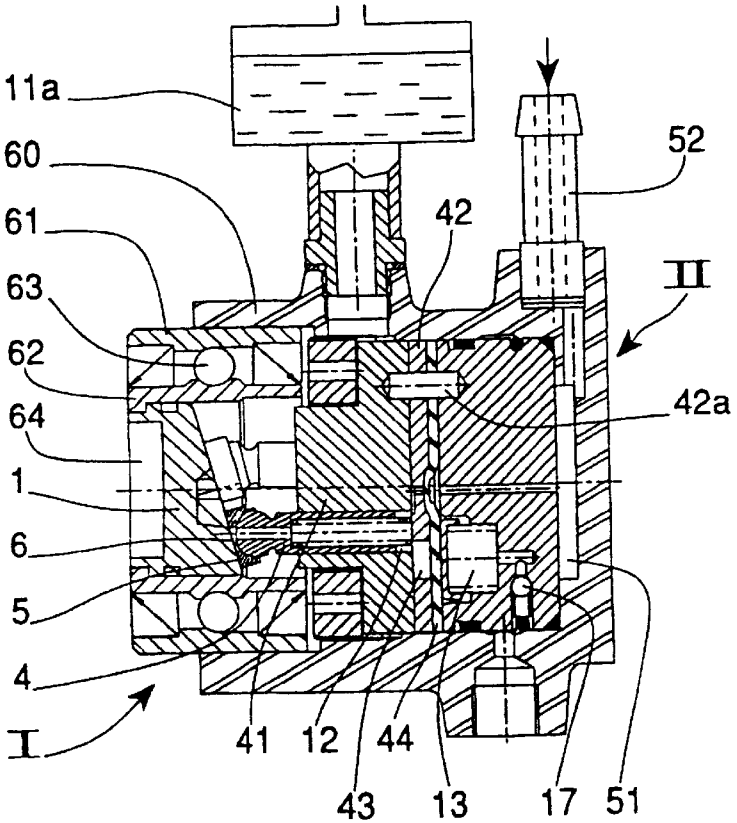
FIG. 9 is a longitudinal cross-section of another embodiment of the pump in which the suction valves have been eliminated.

FIG. 9 represents another embodiment of the pump in FIGS. 6 to 8.

In this embodiment, the essential difference concerns the mechanical constitution of the hydraulic pump I.

This hydraulic pump I comprises, like the pumps in FIGS. 1, 3 and 6, a slanted plate 1 against which tubular pistons 4 rest through the intermediary of sliding contact pieces 5 drilled with a bore 6 intended to come and move over a crescent 8. However, in the pumps previously described, the slanted plate 1 is located at the end of a primary shaft 2 borne by bearings 3; whereas in the pump in FIG. 9, the slanted plate 1 is integrated into a ball bearing.

This ball bearing comprises an outer cap 61 secured inside the housing 60 of the pump, and an inner cap 62 to which the slanted plate 1 is secured, a set of balls 63 being located between the two caps 61 and 62. At its rear part, the slanted plate 1 comprises a seat 64 into which the end of a primary shaft (not represented) can slot.

The pump II is identical to the one described in relation to FIG. 6, the same elements bearing the same references.

The only difference stems from the fact that the non-return suction valves 16 are eliminated and that it is the diaphragm 44 itself which is used to fulfill the role of the non-return valves.

In reference to FIG. 9*a*, which is an enlarged view of a portion of FIG. 9, it can be seen that with each chamber 13 is associated a conduit 50 connected to a chamber 51 into which the liquid to be pumped arrives via a conduit 52. The conduit 50 is drilled through the mass of the part 45 and opens out, at its end opposite the chamber 51, against the diaphragm 44. The plate 42—which is positioned between the part 41, in which the bores 12 of the pistons 4 are made, and the part 45 in which the chambers 13 are located—comprises two seats 53 and 54 connected by a conduit 55. The seat 53 is hollowed out of the face of the part 42 which is in contact with the diaphragm 44, whereas the seat 54 is hollowed out of the face which is in contact with the part 41. The configuration of the seat 54 is such that the latter communicates with the bore 12, and the seat 53 extends to the level of the chamber 13.

Thus, when the pressurized liquid is forced back by a piston 4, the pressurized liquid arrives via the seat 54 and the conduit 55 into the seat 53 and the diaphragm is applied, by the hydraulic pressure, against the orifice of the conduit 50 which is thereby obstructed. Conversely, when the piston 4 is in the suction phase, the motion of the collar 20, which pushes the diaphragm back, moves the latter away from the orifice of the conduit 50. As the diaphragm 44 is rammed against the bottom of the seat 53, this clears a space 56 between the diaphragm 44 and the wall of the part 45, and the space 56 ensures communication between the conduit 50 and the chamber 13 thus enabling the liquid to be pumped to be admitted into this chamber.

Preferably, the liquid to be pumped (which is e.g., automotive fuel) should arrive via the pump 52 at a low pressure, of the order of 1 to 2 bars, provided by a known type of electric pump so that, once the hydraulic pressure disappears from the seat 53, the diaphragm 44 will be thrust back to clear the passage 56.

It is also preferable that, at the level of each conduit orifice 50, the diaphragm 44 be fitted with a reinforcing collar 57, of wider diameter than the orifice, whose purpose will be to avoid the diaphragm being thrust, by the pressure exerted, into the orifice of the conduit 50 and thus being subjected to deterioration.

It is also advantageous to shape the diaphragm by molding in such a way that, at rest, in the absence of any pressure, it fills the seat 53 and clears the passage 56.

Thus, in deforming itself between a position in which it is situated at the bottom of the seat 53 and a position in which it obstructs the suction conduit 50, the diaphragm 44 plays the role of non-return suction valve.

The conduits 50, seat 53, conduit 55, seat 54 will, of course, be as numerous as the bores 12 and chambers 13.

The arrangement thus described in reference to FIGS. 9 and 9*a* is independent of the configuration of the hydraulic pump I and can be transposed to the pump of FIGS. 6 to 7 as represented in FIG. 9.

In all the examples represented in FIGS. 1 to 9, the hydraulic pump I is an oscillating plate or slanted plate pump and the pistons are axial pistons.

However, it should be remarked that the same result can be obtained with a radial piston pump provided the pistons are tubular and provided the heads thereof rest against the drive cam (fulfilling the same role as the slanted plate 1) by means of sliding contact pieces which come and move over a crescent; so that, at the end of each compression cycle, the chamber in which the diaphragm moves is made to communicate directly with the hydraulic liquid admission chamber.

Figure 11:
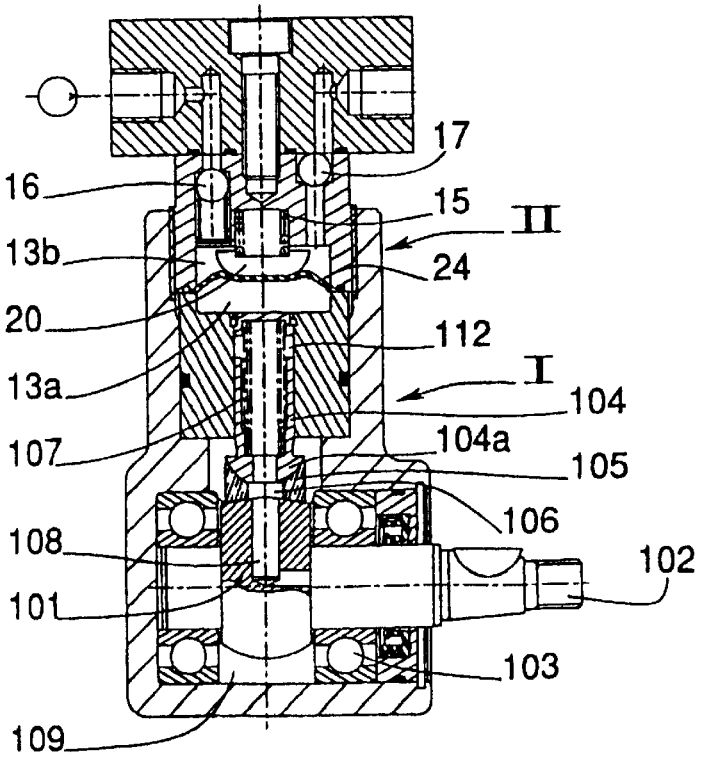
FIG. 11 is a view of another embodiment in which the hydraulic pump is a radial pump.

Such a radial piston pump is represented in FIG. 11.

This pump comprises a cam 101, which is an eccentric borne by a primary shaft 102 itself borne by bearings 103. Each piston is a tubular piston 104 held in countercheck by a spring 107, so that its head 104*a* rests against the cam 101 via a sliding contact piece 105 passed through by an orifice 106. The cam 101 moves about in a chamber 109 communicating with a reservoir of hydraulic liquid (not represented). Communication between the chamber 109 and the interior of each tubular piston 104 is established when the contact piece 105 moves over the groove 108 hollowed out in the cam 101.

The pump II is identical to the one in FIG. 1, and the same elements bear the same references.

The cam 101 corresponds to the slanted plate 1; the pistons 104 correspond to the pistons 4; the contact pieces 105 to the contact pieces 5; the groove 108 to the crescent 8 and the chamber 109 corresponds to the chamber 9.

Figure 10:
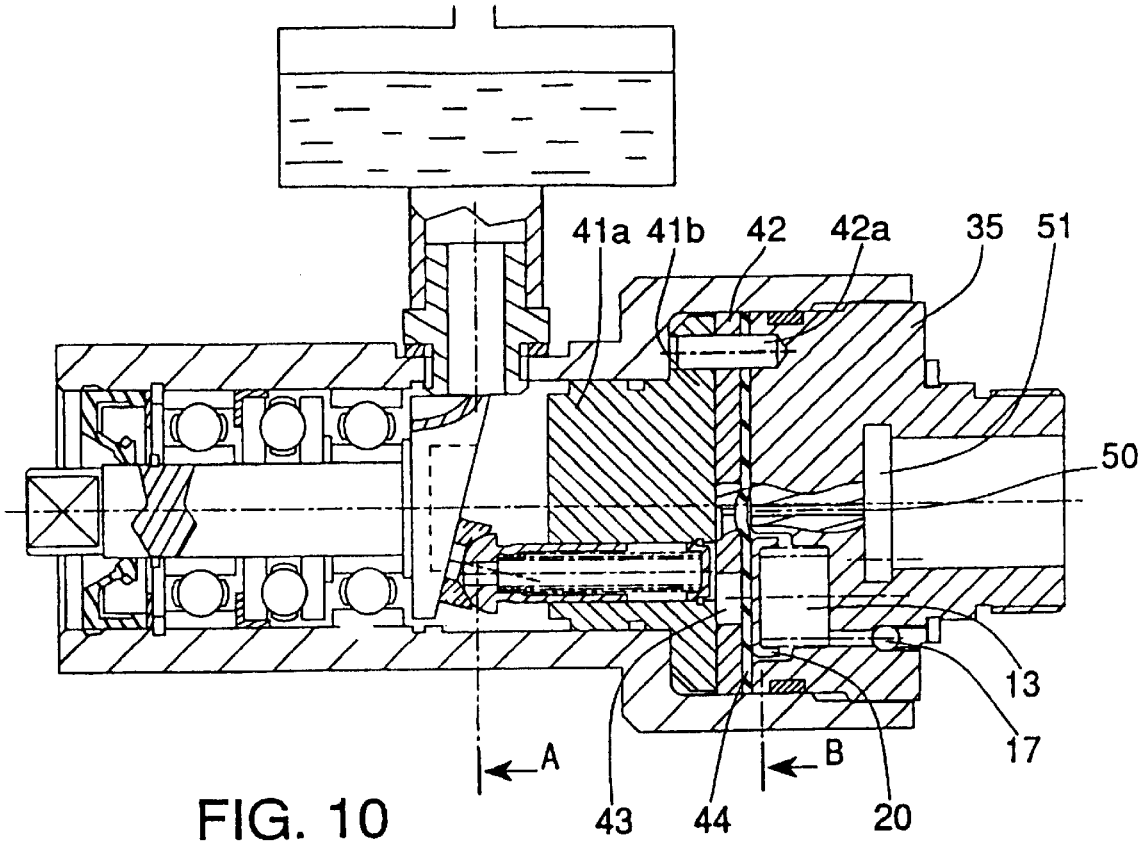
FIG. 10 is a longitudinal cross-section of the pump in FIG. 6 fitted with the diaphragm suction system of FIG. 9.

The operation of the double pump (I–II) represented in FIG. 10 is identical to that of the pumps previously represented.

What is claimed is:

1. A pump including a first hydraulic pump component in fluid communication with a second pump component, wherein the first hydraulic pump component comprises:

a hydraulic fluid chamber, at least one piston in intermittent fluid communication with the hydraulic fluid chamber, the at least one piston being a tubular piston defining a piston chamber therein that receives hydraulic fluid from the hydraulic fluid chamber, the piston comprising (1) a piston head abutting the slanted plate via a sliding contact piece, wherein the sliding contact piece includes a bore therein in fluid communication with the piston chamber, and (2) a spring engaging the piston head, a slanted plate piston driving mechanism coupled with the at least one piston, the piston driving mechanism reciprocating the piston between a suction position and a delivery position, and the spring urging the piston toward the suction position, wherein the piston driving mechanism comprises a crescent opening therein in fluid communication with the hydraulic fluid chamber and in intermittent fluid communication with the piston chamber of the tubular piston when the driving mechanism reciprocates the piston from the delivery position toward the suction position; and wherein the second pump component comprises:

at least one pump chamber, corresponding to the at least one piston, including a flexible diaphragm therein dividing the pump chamber into a pumping section and a delivery section, the pumping section of the pump chamber being in fluid communication with the piston chamber of the tubular piston such that the flexible diaphragm is reciprocated by displacement of hydraulic fluid by the first hydraulic pump and such that when the driving mechanism of the first hydraulic pump reciprocates the piston from the delivery position toward the suction position, the pumping section, the piston chamber and the hydraulic fluid chamber are in fluid communication with one another.

2. A pump according to claim 1, wherein a circular plate is placed between a first part in which a bore receiving the at least one piston is located and a second part in which the pump chamber is located, and wherein communication between the bore and the pump chamber is established by way of drilled holes in the circular plate.

3. A pump according to claim 1, wherein the slanted plate is a plate with variable inclination.

4. A pump according to claim 1, further comprising a pump housing, wherein the slanted plate piston driving mechanism further comprises a ball bearing assembly including an outer cap secured to the pump housing and an inner cap securing the slanted plate.

5. A pump according to claim 1, further comprising means for varying the flow rate of the first hydraulic pump component and, therefore, the rate of the second pump component.

6. A pump according to claim 5, wherein the varying means comprises openings that can be completely or partly blocked off by a mobile liner moved by a control unit.

7. A pump according to claim 6, wherein the first hydraulic pump component comprises two pistons slidably supported in two support members, respectively, drilled with orifices and separated from each other by a flow chamber, and wherein the mobile liners are disposed in the flow chamber and are shiftable between a maximum pump rate position covering the openings and a zero pump rate position clear of the openings.

8. A pump according to claim 7, wherein the liners are shiftable to intermediate positions between the zero pump rate position and the maximum pump rate position.

9. A pump according to claim 8, wherein the liners are coupled to a common control unit which is driven by a control device.

10. A pump according to claim 9, wherein a damping device is located downstream of an outlet of the second pump component.

11. A pump according to claim 1, wherein the second pump component further comprises a spring engaging the flexible diaphragm via a collar in the delivery section.

12. A pump according to claim 11, wherein the flexible diaphragm acts as a suction valve and wherein the second pump component further comprises a delivery valve in the delivery section of the pump chamber, the flexible diaphragm and the delivery valve working cooperatively to draw and deliver a product to be pumped.

13. A pump according to claim 12, wherein an intake conduit for the product to be pumped opens out against the flexible diaphragm which is held against an orifice of said conduit during a delivery phase, and is removed therefrom during a suction phase.

14. A pump according to claim 13, wherein the portion of the flexible diaphragm bearing against the intake conduit is fitted with a reinforcing collar.

15. A pump according to claim 13, wherein, during the suction phase, the flexible diaphragm fits into the bottom of a seat in order to clear a passage for communication between the intake conduit and the pump chamber.

16. A pump according to claim 15, wherein the flexible diaphragm is performed by molding to occupy the bottom of the seat, during the suction phase, in order to clear the passage.

17. A pump according to claim 1, wherein the second pump component further comprises a suction valve and a delivery valve in the delivery section of the pump chamber, the suction valve and the delivery valve working cooperatively to draw and deliver a product to be pumped.

18. A pump according to claim 17, wherein the second pump component further comprises a spring engaging the flexible diaphragm in the delivery section, the spring urging the diaphragm toward a product drawing position, wherein when the driving mechanism of the first hydraulic pump reciprocates the piston from the suction position toward the delivery position, the flexible diaphragm is deflected against the spring toward a product delivery position, thereby reducing a volume of the delivery section of the pump chamber.

19. A pump according to claim 18, wherein the spring rests against a rear side of the flexible diaphragm via a collar shaped so as not to deteriorate said rear side of the diaphragm.

20. A pump according to claim 1, further comprising a hydraulic fluid reservoir in fluid communication with the hydraulic fluid chamber.

21. A pump according to claim 20, wherein the reservoir is on the exterior of the first pump component and communicates with the first pump component by a pipe leading into the hydraulic fluid chamber.

22. A pump according to claim 20, wherein the reservoir is constituted by a cylindrical envelope surrounding the first pump component and communicating with the hydraulic fluid chamber by a plurality of orifices.

23. An internal combustion engine including fuel injectors receiving high pressure fuel from a pump including a first hydraulic pump component in fluid communication with a second pump component, wherein the first hydraulic pump component comprises:

a hydraulic fluid chamber, at least one piston in intermittent fluid communication with the hydraulic fluid chamber, the at least one piston being a tubular piston defining a piston chamber therein that receives hydraulic fluid from the hydraulic fluid chamber, the piston comprising (1) a piston head abutting the slanted plate via a sliding contact piece, wherein the sliding contact piece includes a bore therein in fluid communication with the piston chamber, and (2) a spring engaging the piston head, a slanted plate piston driving mechanism coupled with the at least one piston, the piston driving mechanism reciprocating the piston between a suction position and a delivery position, and the spring urging the piston toward the suction position, wherein the piston driving mechanism comprises a crescent opening therein in fluid communication with the hydraulic fluid chamber and in intermittent fluid communication with the piston chamber of the tubular piston when the driving mechanism reciprocates the piston from the delivery position toward the suction position; and wherein the second pump component comprises:

at least one pump chamber, corresponding to the at least one piston, including a flexible diaphragm therein dividing the pump chamber into a pumping section and a delivery section, the pumping section of the pump chamber being in fluid communication with the piston chamber of the tubular piston such that the flexible diaphragm is reciprocated by displacement of hydraulic fluid by the first hydraulic pump and such that when the driving mechanism of the first hydraulic pump reciprocates the piston from the delivery position toward the suction position, the pumping section, the piston chamber and the hydraulic fluid chamber are in fluid communication with one another.

24. An internal combustion engine according to claim 23, wherein the hydraulic fluid chamber is an engine oil reservoir.

25. An internal combustion engine according to claim 23, further comprising a damping device located downstream of an outlet of the second pump component and upstream of the fuel injectors, the damping device having a capacity of sizable volume in relation to an engine fuel rate maintained at an injection pressure.

* * * * *